US006958444B1

(12) United States Patent
Chou

(10) Patent No.: US 6,958,444 B1
(45) Date of Patent: Oct. 25, 2005

(54) ROUND-FLAT TWISTED PAIR CABLE ASSEMBLY

(75) Inventor: Chih-Hsien Chou, San Jose, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/050,967

(22) Filed: Feb. 3, 2005

(51) Int. Cl.[7] ..... H01B 11/02

(52) U.S. Cl. ..... 174/27; 174/113 R; 174/117 F

(58) Field of Search ..... 174/27, 113 R, 174/117 F, 36

(56) References Cited

U.S. PATENT DOCUMENTS

| | | | | |
|---|---|---|---|---|
| 4,767,891 | A * | 8/1988 | Biegon et al. | 174/34 |
| 5,142,105 | A * | 8/1992 | Kihlken et al. | 174/112 |
| 5,767,442 | A * | 6/1998 | Eisenberg et al. | 174/36 |
| 6,717,058 | B2 * | 4/2004 | Booth et al. | 174/117 F |

* cited by examiner

*Primary Examiner*—Chau N. Nguyen
(74) *Attorney, Agent, or Firm*—Wei Te Chung

(57) ABSTRACT

This invention is to provide a general equation for the round-flat twisted-pair cable arrangement to achieve maximum or any degree of crosstalk-noise cancellation in a short distance with the uniform twist of the individual twisted-pair and the uniform offset of the local twist shift angle for neighbor twisted pairs.

20 Claims, 14 Drawing Sheets

Adopt different twist pitch at different layers, such as 1:2:1

——— Pairs with the twist pitch 1 ——— Pairs with the twist pitch 2
The ratio between twist pitches 1 and 2 is 1:2 or in reverse to achieve the best crosstalk performance.

Poor crosstalk performance between pairs in the adjacent layers

Adopt different twist pitch at different layers, such as 1:2:1

——— Pairs with the twist pitch 1 ——— Pairs with the twist pitch 2

The ratio between twist pitches 1 and 2 is 1:2 or in reverse to achieve the best crosstalk performance.

the pairs in the odd layer will keep flat and the pairs in the even layer will twist 180 degrees at the middle of the flat section or vise versa. This will cancel out the crosstalk noise for the differential signal.

The length of the flat area is the integral multiple of the twist pitch. Then, the location of the flat areas in the odd layers will shift some distance with respect to the flat areas in the even layers so that there is no overlap. between the flat areas in the odd layers and in the even layers.ddle of the flat section or vise versa. This will cancel out the crosstalk noise for the differential signal.

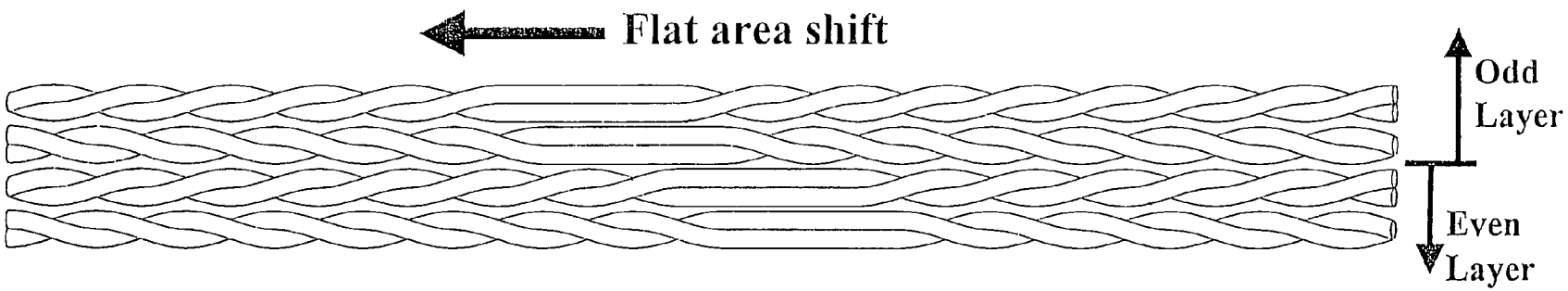

FIG 6B

Twisted-Pair Flat Cable

Round-Flat Twisted-Pair Cable

ROUND-FLAT TWISTED PAIR CABLE ASSEMBLY

BACKGROUND OF THE INVENTION

1. Field of the Invention

The invention relates to round-flat twisted-pair cables, and particularly to an offset arrangement among the neighboring twisted-pairs to reduce the crosstalk therebetween.

2. The Related Art

The round-flat twisted-pair cable (FIG. 8), which is essentially a twisted-pair flat cable (FIG. 7) in a roll manner, can provide some advantages of saving the occupied space and leaving more space for heat transfer airflow as well as for the cable layout inside the chassis for termination efforts, in comparison with the traditional twisted-pair flat cable which inevitably and essentially extends in a plane as shown in U.S. Pat. No. 4,381,426. It is noted the so-called twisted-pair cable essentially refers to the differential pair cable in a twisted manner for each pair thereof.

However, the round-flat twisted-pair cable may inevitably generate a high crosstalk amounted accumulated by not only the neighboring twisted-pairs in the same layer but also the neighboring twisted-pairs in the adjacent upper and lower layers. In the past, there were many kinds of arts to arrange the twisted pairs for twist flat cable for reducing the crosstalk thereof. Some were based upon varied pitches which might cause some non-uniform impedance and propagation dealy. Also, achievement of the cancellation of the crosstalk was required with the common-integer turns of the twisted pairs, which might take a long distance/length of the twisted pairs for complete cancellation. Such a pitch variation method for cancellation of the twisted pairs essentially fit for the low frequency transmission only. Additionally, the pitch variation method required trial-and error to figure out the lay variation for maximum reduction of noise, such as current SCSI round flat cables. When frequency transmission gets higher and higher, it is desired to have a scientific and systematic method. The inventor developed some systematic and scientific methods before for reduction the crosstalk of the flat type twisted pair cable as disclosed in U.S. Pat. No. 6,348,651, and the bundle type twisted pair cable as disclosed in U.S. Pat. Nos. 6,794,570 and 6,825,410, while so far, there is no invention addressing the methodology of the twisted pair arrangement to obtain the best crosstalk performance for the round-flat twisted pair cables.

SUMMARY OF THE INVENTION

The invention is to provide a general equation for the round-flat twisted-pair cable arrangement to achieve maximum or any degree of crosstalk-noise cancellation in a short distance with the uniform twist of the individual twisted-pair and the uniform offset of the local twist shift angle for neighbor twisted pairs.

The advantage of the invention is to cancel out noises in a short distance/length of the twisted-pairs for high frequency transmission. Moreover, the arrangement will give a uniform differential impedance and propagation delay with easy manufacturing. Other approaches are also presented to reduce the crosstalk between pairs in adjacent layers in the twisted pair area and the flat area for the round-flat twisted-pair cable.

BRIEF DESCRIPTION OF THE DRAWINGS

FIGS. 6(A) and 6(B) show two ways applied to the flat sections of the twisted pair to reduce the crosstalk of the neighboring pairs respectively located in different layers.

DETAILED DESCRIPTION OF THE PREFERRED EMBODIMENTS

In an earlier design as disclosed in U.S. Pat. No. 6,348,651, it is proved that the twisted pairs with different twisting directions cancel out the crosstalk noise derived between the two neighboring twisted-pairs under a 90 degrees phase offset therebetween. As shown in U.S. Pat. No. 6,348,651, the phase offset is calculated from the offset of the twist stating point from the flat pairs in the twist Generally, any degrees of the phase offset between the two neighboring twisted-pairs can reduce the crosstalk noise therebetween. Anyhow, the closer to the 90 degrees the phase-offset angle is, the more the crosstalk noise is canceled. This theory can be applied to the round-flat twisted pair cable which is derivatively rolled from the flat twisted pair cable but is no longer the flat twisted pair cable. Understandably, as disclosed in the aforementioned 6,794,570 and 6,825,410 patents, the phase offset is based upon the local phase angle. The so-called phase offset with regard to the so-called local coordinate and to the so-called global coordinate mentioned later in the instant invention should be referred to the corresponding illustration in these two patents.

Figure 1:
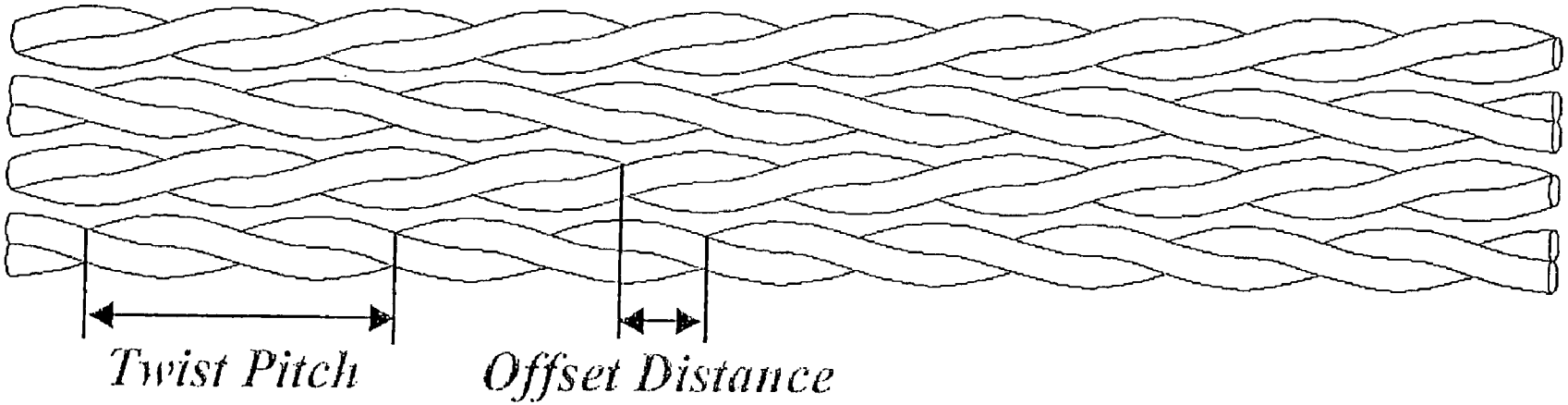
FIG. 1 shows the noise self-cancellation in the flat twisted pair cable.
Figure 2:
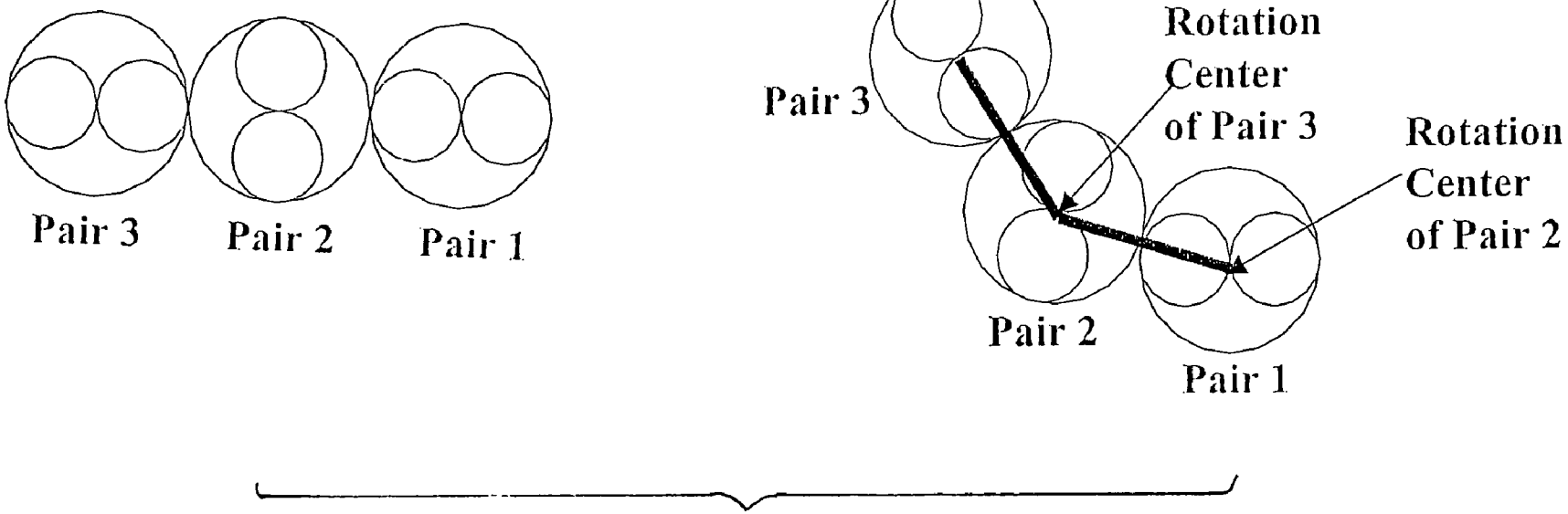
FIG. 2 shows the formation from the pure flat twisted pair to the round-flat twisted pair via a rolling process.

The theory of crosstalk noise self-cancellation in the flat twisted-pair cable, as shown in FIG. 1, will be applied and extended to the found-flat twisted-pair cable with the uniform twist pitch thereof. The creation of round of the round-flat twisted-pair cable is to first make the flat twisted-pair cable, and then roll the flat twisted-pair cable to form a rolling/round shape, as shown in FIG. 2. Understandably, the rolling process will make the whole twisted-pair cable from two dimensions to three dimensions, and also will change the global pair centerline angle and definitely the original global phase offset set in the twisted-pair flat cable. Therefore, the phase offset needs to be re-defined generally not only for two dimensional but also thee dimensional twisted-pair cable at the rolling stage.

As disclosed in the aforementioned two related patents, there are two defined angles adopted in the theory wherein the first is the global angle related to the twisted pair arrangement in design and the twist phase offset based upon this global angle is the so-called global phase offset angle or global pair centerline angle. The center of the global angle is located at the twist axis of each individual twisted pair, and the zero-degree axis of the global angle is arranged to be parallel to the zero-degree axis of the global coordinate. The second is the local angle used to examine the cancellation effect of crosstalk noise and the twist phase offset based upon this local angle is the so-called local phase offset angle. The center of the local angle is located at the twist axis of the individual twisted-pair and the zero-degree axis of the local angle is parallel to the line linked between the two centers based upon the global angles of the two corresponding neighboring twisted pairs.

Figure 3A:
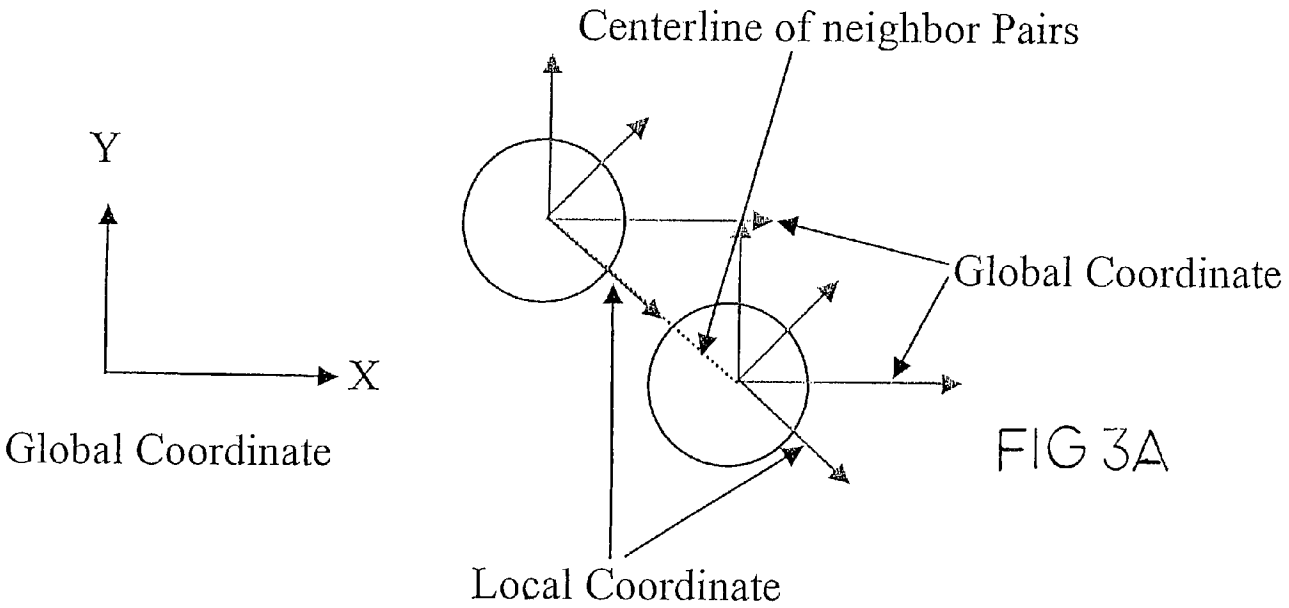
FIG. 3(A) and FIG. 3(B) show the definition of the local phase offset angle and the global phase offset angle.
Figure 3B:
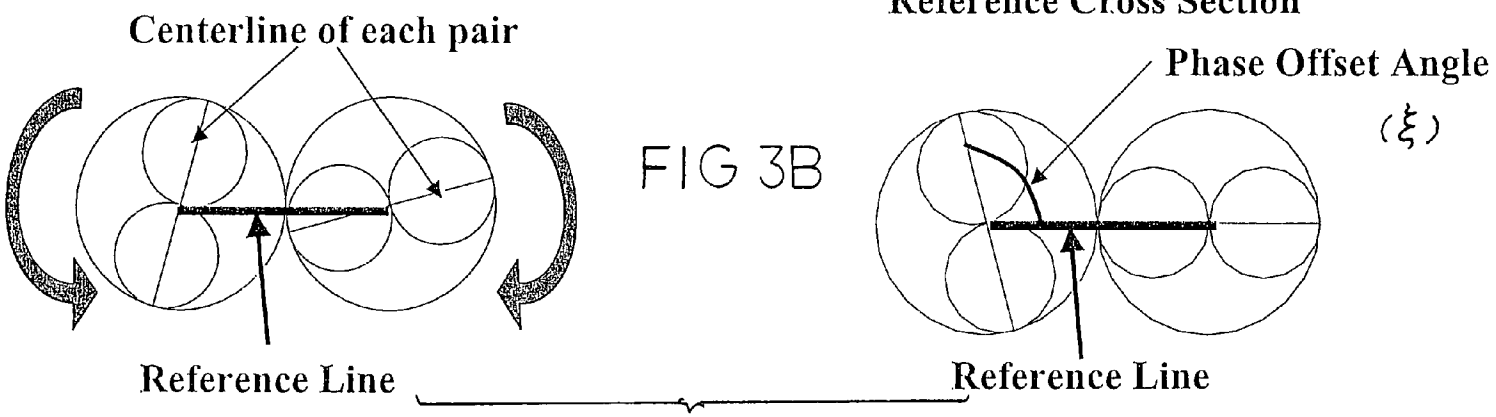

FIGS. 3(A) and 3(B) show such a definition. It is understood that if there is any relative twist phase offset in the local angles between the two neighboring pairs when one twisted pair is aligned with the local zero-degree axis, such a twist phase offset will result in some degrees of crosstalk noise cancellation in the neighboring twisted pairs of the round-flat twisted pair cable regardless of whether the twist directions of these two neighboring twisted pairs are same or opposite, i.e., clockwise or counterclockwise.

FIGS. 4(A)–(D) show the methodology. In opposite, if the two twisted pairs form no relative twist phase offset in the local angles therebetween when one twisted pair is aligned with the local zero-degree axis, no cancellation will occur and the maximum crosstalk noise from the neighboring twisted pairs of the round-flat twisted-pair cable exists.

In this embodiment, the twisted-pairs have the uniform/unvaried twist pitch. Understandably, the uniform twist will give the advantage of uniform differential impedance and propagation delay. The crosstalk noise is based upon the differential signals. It is also noted that the clockwise rolling and the counterclockwise rolling are deemed same due to the viewer positions.

It is noted that due to the rolling process, the local angle for each twisted-pair relative to the neighboring twisted-pair will change, and design of the cable becomes complicated. To display the whole assembly in a friendly and comprehensive way, the local coordinate is converted to the global coordinate to arrange the twisted-pairs with uniform twist pitch to cancel the crosstalk noise between the neighboring twisted-pairs of the round-flat twisted-pair cable in the higher frequency application. It means the cable will have uniform twist pitch for differential-signal applications. Understandably, the global angle is really physical angle for the whole cable assembly. According to calculation, following arrangement rule/equation will give the full/optimized crosstalk noise cancellation for every adjacent two twisted-pairs of the round-flat twisted-pair cable based upon the resulted/calculated respective/individual global angle.

Figure 4A:
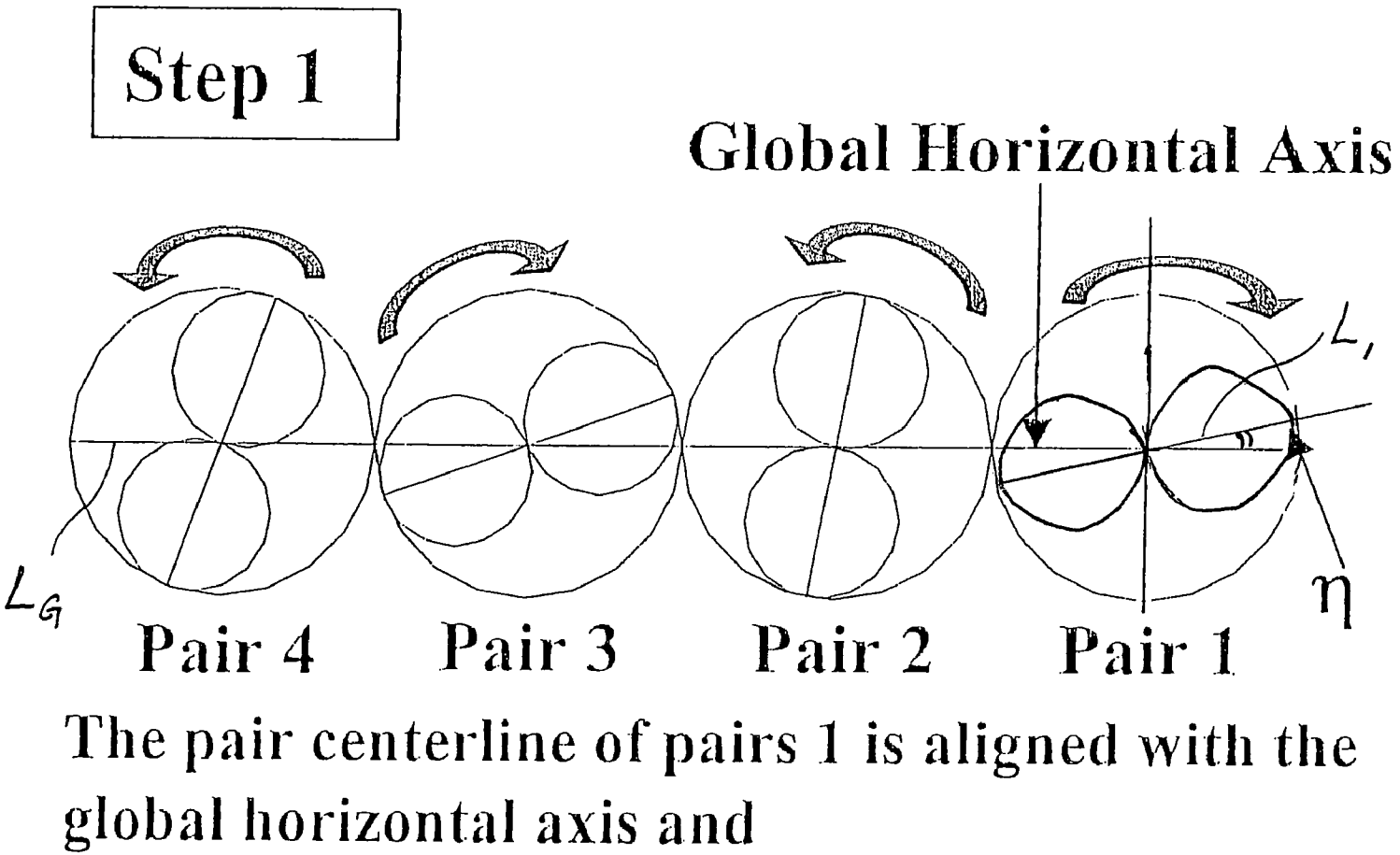
FIGS. 4(A)–4(D) show twisted pairs 1–4 and the structural relation therebetween with one another and with regard to the global coordinate.
Figure 4B:
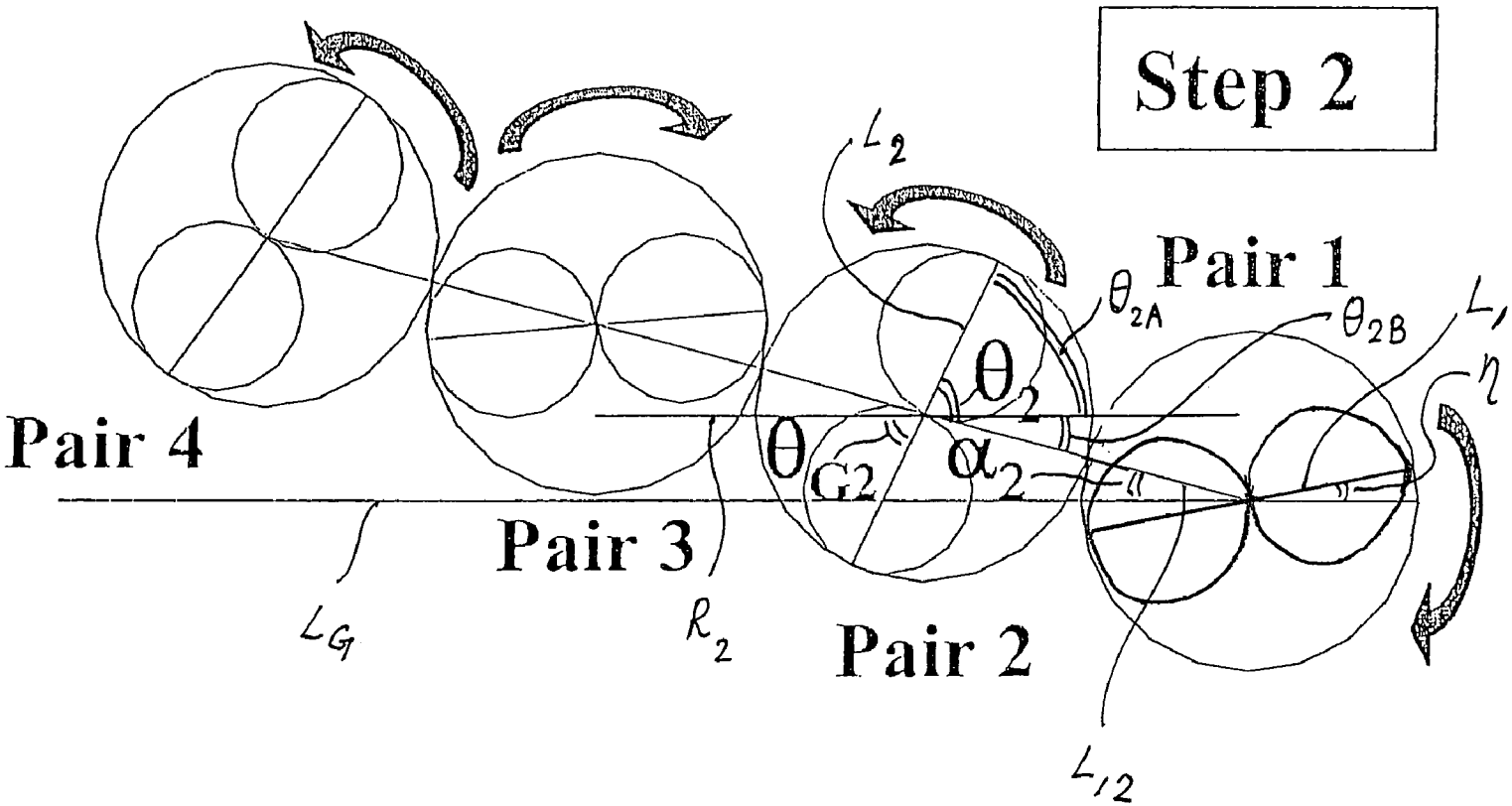

Referring to FIG. 4(A), the global center line angle $\theta_{G1}$ of pair 1, which is defined between the centerline $L_1$ of pair 1 (i.e., the line defined by two centers of pair 1) and the global horizontal axis $L_G$ is $\eta$. Further referring to FIG. 4(B), the global pair centerline angle $\theta_{G2}$ of pair 2, next to pair 1, is $(\xi-2\alpha_2-\eta)$ degrees when the twist direction of pair 2 is reverse from that of pair 1, wherein $\xi$ is the local phase offset angle between pair 1 and pair 2, and $\alpha_2$ is the angle defined between the centerline $L_{12}$ of pairs 1 and 2 and the initial line of pair 1, i.e., the global horizontal axis $L_G$. This results from the following calculations:

$\xi=\theta_2+\eta+\alpha_2$ (Equation 1) wherein 02 is the angle between the centerline $L_2$ of pair 2 (i.e., the line defined by two centers of pair 2) and the centerline $L_{12}$ of pairs 1 and 2 (i.e., the line defined by the center of pair 1 and the center of pair 2). This calculation is to have the centerline $L_{12}$ of pairs 1 and 2 in alignment with the centerline $L_1$ of pair 1, so as to decide/obtain the local phase offset angle $\xi$ between pairs 1 and 2.

On the other hand, $\theta_{G2}=\theta_2-\alpha_2$ (Equation 2). It is because the reference line $R_2$ of pair 2, which is parallel to the global horizontal axis $L_G$ and cooperates with the centerline $L_2$ of pair 2 for determining the global pair centerline angle $\theta_{G2}$, can divided $\theta_2$ into two adjacent angles $\theta_{2A}$ and $\theta_{2B}$ wherein $\theta_{2A}=\theta_{G2}$ (for reason of the so-called vertical angles) and $\theta_{2B}=\alpha_2$ (for reason of the so-called alternate interior angles).

From $\theta_2=\xi-\alpha_2-\eta$ (Equation 1), which substitutes in $\theta_{G2}=\theta_2-\alpha_2$ (Equation 2) so as to obtain $\theta_{G2}=\xi-2\alpha_2-\eta$ (solution for pair 2, i.e., the global pair centerline angle). Therefore, as long as $\xi$, $\alpha_2$ and $\eta$ are predetermined, it is easy to specifically set the pair 2 at the specific global pair centerline angle $\theta_{G2}$ for reaching the desired $\xi$ which essentially is expected to be 90 degrees.

Figure 4C:
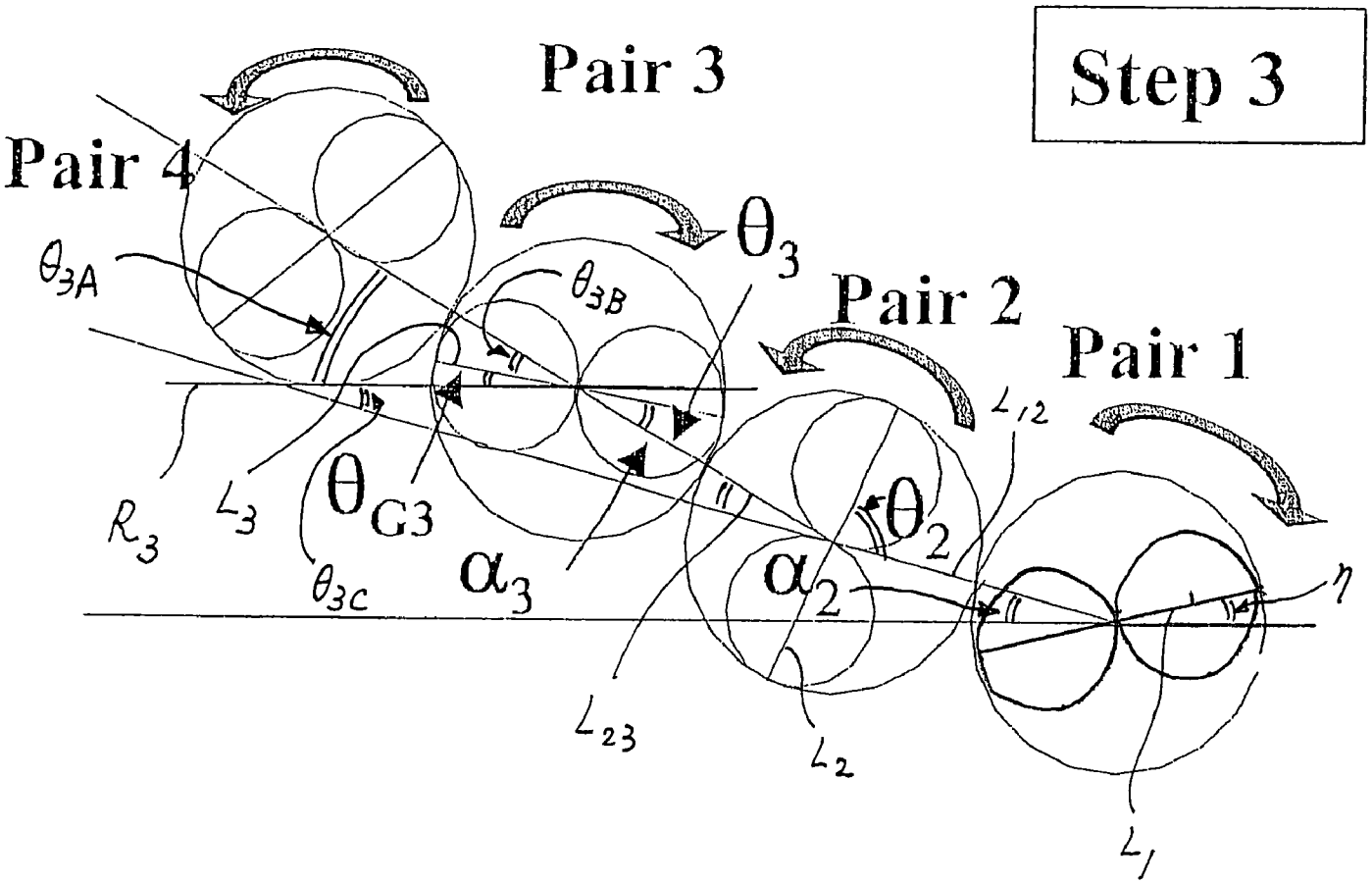

Similarly, referring to FIG. 4(C) the global pair centerline angle $\theta_3$ of pair 3 (next to pair 2) is $(-2\alpha_3+\eta)$ degrees when the twist direction of pair 3 is reverse from that of pair 2 wherein $\alpha_3$ is the angle between the centerline $L_{23}$ of pairs 2 and 3 and the centerline $L_{12}$ of pairs 1 and 2. This result is derived from the following calculation:

Similar to Equation 1, $\xi=\theta_3+\theta_2+\alpha_3$ (Equation 3) wherein $\xi$ is the local offset angle between pair 2 and pair 3 under a condition in this preferred embodiment $\xi$ is intentionally set as a constant and expected to be 90 degrees for full cancellation of the crosstalk with neighboring pair 2, $\theta_3$ is defined between the centerline $L_3$ of pair 3 and the centerline $L_{23}$ of pairs 2 and 3. Similar to what is explained in an earlier time for calculating $\xi$ between pairs 1 and 2, Equation 3 is obtained by having the centerline $L_{23}$ of pairs 2 and 3 in alignment with the centerline $L_2$ of pair 2, so as to decide/obtain the local phase offset angle $\xi$ between pairs 2 and 3.

On the other hand, $\theta_{G3}=\theta_3-\alpha_2-\alpha_3$ (Equation 4) for the following reasons: The reference line $R_3$ of pair 3, which is parallel to the global horizontal axis $L_G$ and cooperates with the centerline $L_3$ of pair 3 for determining $\theta_{G3}$, also cooperates with the centerline $L_{23}$ of pairs 2 and 3 to for intersect with each other to form a reference angle $\theta_{3A}$ which can be divided into two adjacent angles $\theta_{3B}$ and $\theta_{G3}$, wherein $\theta_{3B}$, similar to $\theta_3$, is defined by intersection of the centerline $L_3$ of pair 3 and the centerline $L_{23}$ of pairs 2, and 3 and at the same time, $\theta_{3C}$ is formed by/between the centerline $L_{12}$ of pairs 1 and 2 and the reference line $R_3$ of pair 3. Because $\theta_{3C}=\alpha_2$ (for reason of the so-called the alternate interior angles) and $\theta_{3A}=\theta_{3C}+\alpha_3$ (for reason of the amount of the exterior angle being equal to the sum of two remote interior angles), $\theta_{3A}=\alpha_2+\alpha_3$. In addition, $\theta_{3B}=\theta_3$ (for reason of the so-called vertical angles). Because (1) $\theta_{3A}=\theta_{3B}+\theta_{G3}$, (2) $\theta_{3A}=\alpha_2+\alpha_3$, and (3) $\theta_{3B}=\theta_3$, thus $\theta_{G3}=-\theta_3+\alpha_2+\alpha_3$. Moreover, because the above calculation is based upon the absolute value while $\theta_{G3}$ is essentially a negative angle, thus $\theta_{G3}=-\theta_3+\alpha_2+\alpha_3$ is converted to be $\theta_{G3}=\theta_3-\alpha_2-\alpha_3$.

From $\xi=\theta_2+\eta+\alpha_2$ (Equation 1) and $\xi=\theta_3+\theta_2+\alpha_3$ (Equation 3), thus $\theta_3=\alpha_2-\alpha_3+\eta$ (Equation 5) by canceling $\xi$ because, as mentioned earlier, $\xi$ is intentionally set as a constant and expected to be 90 degrees for full cancellation of the crosstalk with every two neighboring pairs. From $\theta_{G3}=\theta_3-\alpha_2\alpha_3$ (Equation 4) and $\theta_3=\alpha_2-\alpha_3+\eta$ (Equation 5), thus obtaining $\theta_{G3}=-2\alpha_3+\eta$ (solution for pair 3, i.e., the global pair centerline angle).

Figure 4D:
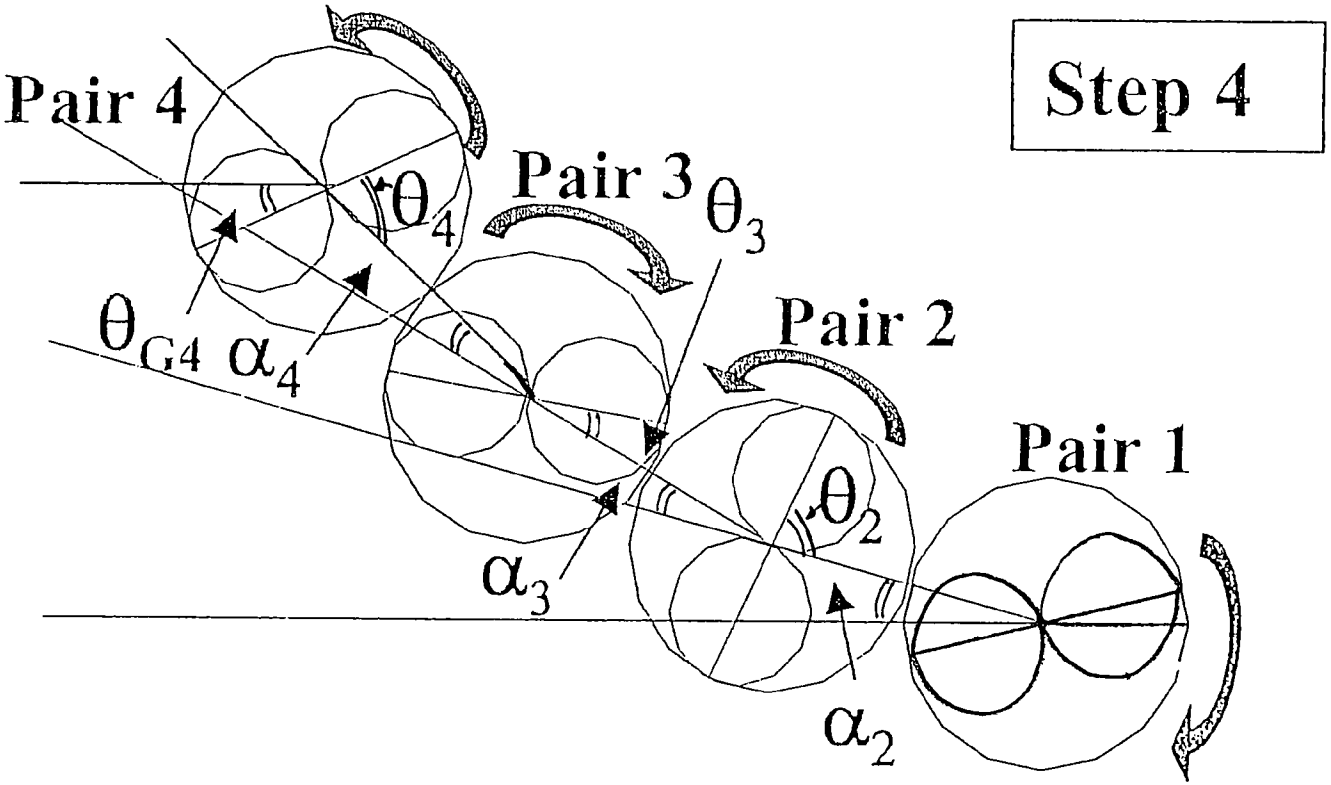

By following the same rule, referring to FIG. 4(D), $\theta_4=\xi-\alpha_4+\alpha_3-\alpha_2-\eta$ and thus $\theta_{G4}=\xi-2(\alpha_2+\alpha_4)-\eta$.

It is noted that the odd number pairs and the even number pairs own respective characters, and a conclusive formula for the global pair centerline angle $\theta_{Gi}$ of the ith pair is obtained by the followings:

$\theta_{Gi}=\frac{1}{2}\xi[1+(-1)^i]+(-1)^{i-}\eta-[\Sigma\alpha_j+(-1)^i\Sigma(-1)^j\alpha_j]$ under a condition of j=2 to i; wherein i and j are integrals, $\theta_{Gi}$ represents the global pair centerline angle of pair i, $\xi$ represents the desired local phase offset angle between pair i and pair i−1, $\eta$ represents the global pair centerline angle of pair 1, and $\alpha_j$ represents the angle between the centerline defined by centers of pairs j and j−1, and another centerline defined by centers of pairs j−1 and j−2. In this embodiment, the outermost pair is designated as the first/initial pair.

As mentioned earlier, preferably $\xi$=90 degrees to completely canceled the crosstalk of the neighboring pairs, and the twist direction of pair i is preferably reverse from that of pair i−1 so as to eliminate the electromagnetic interference to the environment.

On the other hand, another simplified/general formula is obtained to show the relation between the adjacent pairs as follows:

$\theta_{Gi}=\theta_{Gi-2}-2\alpha^i$ wherein $\theta_{Gi}$ represents the global pair centerline angle of pair i, $\theta_{Gi-2}$ represents the global pair centerline angle of pair i−2, and $\alpha_i$ represents the angle between the centerline defined by centers of pairs i and i−1, and another centerline defined by centers of pairs i−1 and i−2. This relation formula can be verified by the aforementioned values $\theta_1$, $\theta_2$, $\theta_3$ and $\theta_4$ wherein $\theta_{G1}=\eta$, $\theta_{G2}=\xi-2\alpha_2-\eta$, $\theta_{G3}=-2\alpha_3+\eta$, and $\theta_{G4}=\xi-2(\alpha_2+\alpha_4)-\eta$.

Therefore, to achieve the constant phase offset $\xi$ between every two neighboring pairs, the global pair centerline angle difference between ith pair and (i−2)th pair is $-2\alpha_i$.

As mentioned in an earlier time, to achieve the full cancellation of the crosstalk between every two neighboring pairs, $\xi$ is designated as 90 degrees. On the other hand, for a common implementation, $\alpha_i$ might be gradually decreased when the radius of the whole round-flat twisted pairs cable is gradually increased. Anyhow, according to the foregoing illustration, the manufacturer can easily arrange the relative positions $\alpha_i$ and the global pair centerline angles $\theta_{Gi}$ of the plural twisted pairs with one another by following the aforementioned formula to approach the zero crosstalk, i.e., $\xi\approx$90 degrees.

Figure 5A:
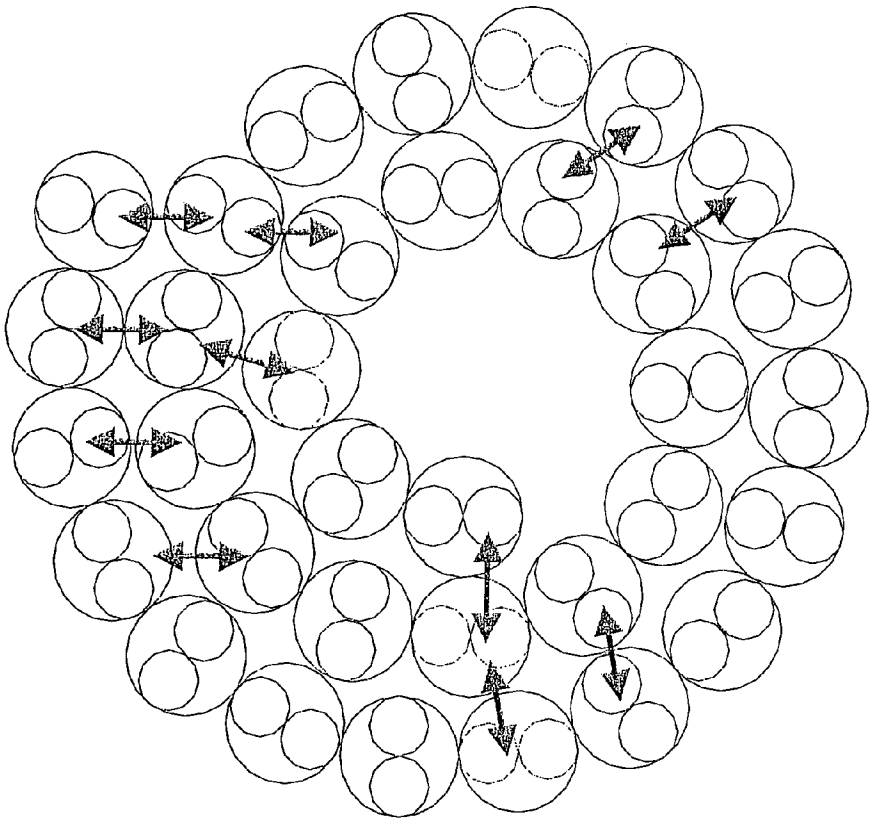
FIGS. 5(A)–(C) show the crosstalk between the neighboring twisted pairs respectively located in different neighboring layers and the two ways to reduce the crosstalk of the neighboring pairs respectively located in different layers.
Figure 5B:
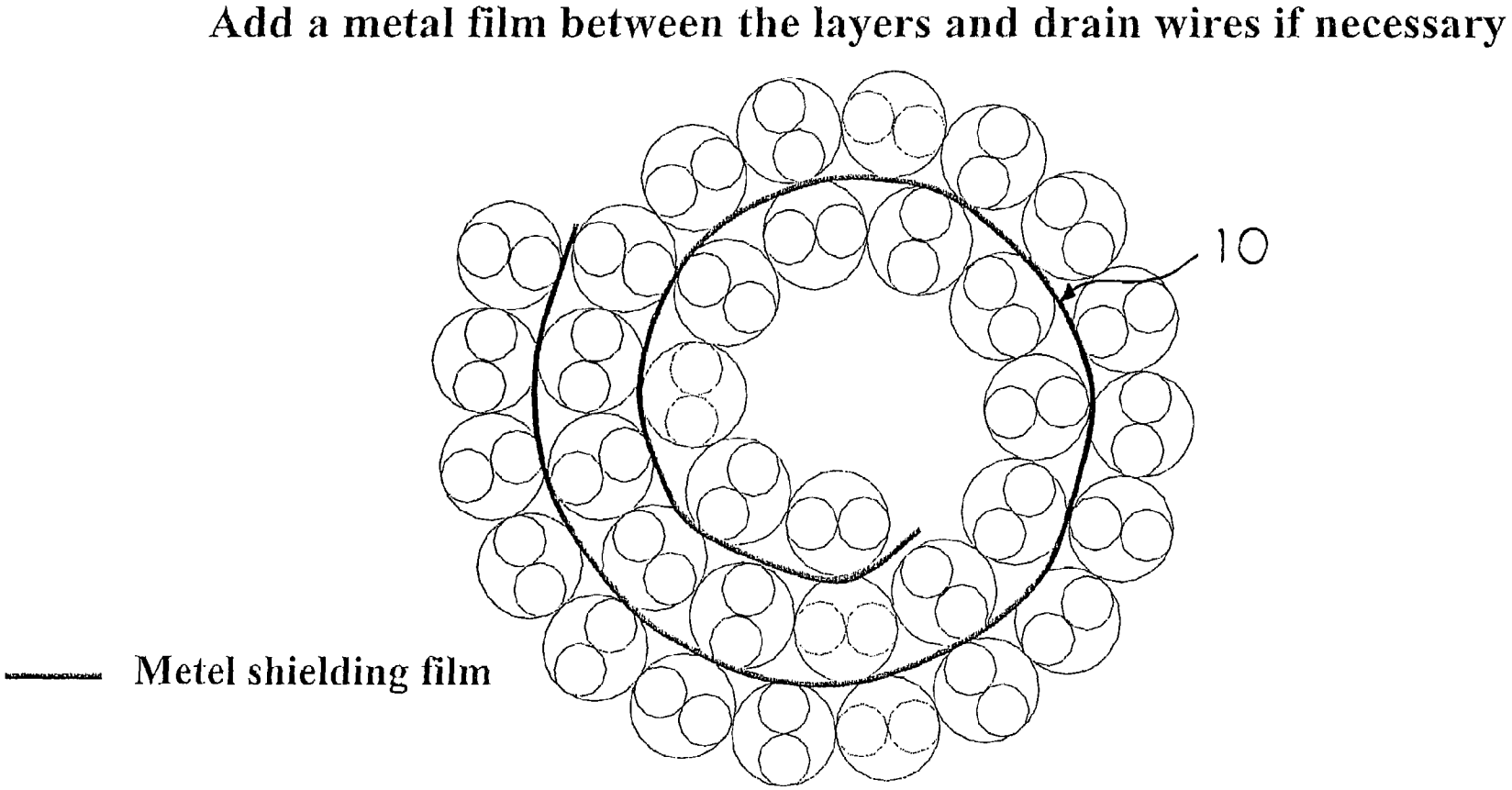

It is also noted although the arrangement can achieve the optimal crosstalk cancellation between the neighboring twisted pairs in the same layer of the rolled cable assembly, the crosstalk of the adjacent pairs in the different/neighboring layers may be still higher without any efficient elimination, referring to FIG. 5A. Accordingly, referring to FIG. 5B, the metal film 10 is added between the neighboring layers for reducing the crosstalk between the neighboring pairs located in different layers.

Figure 5C:
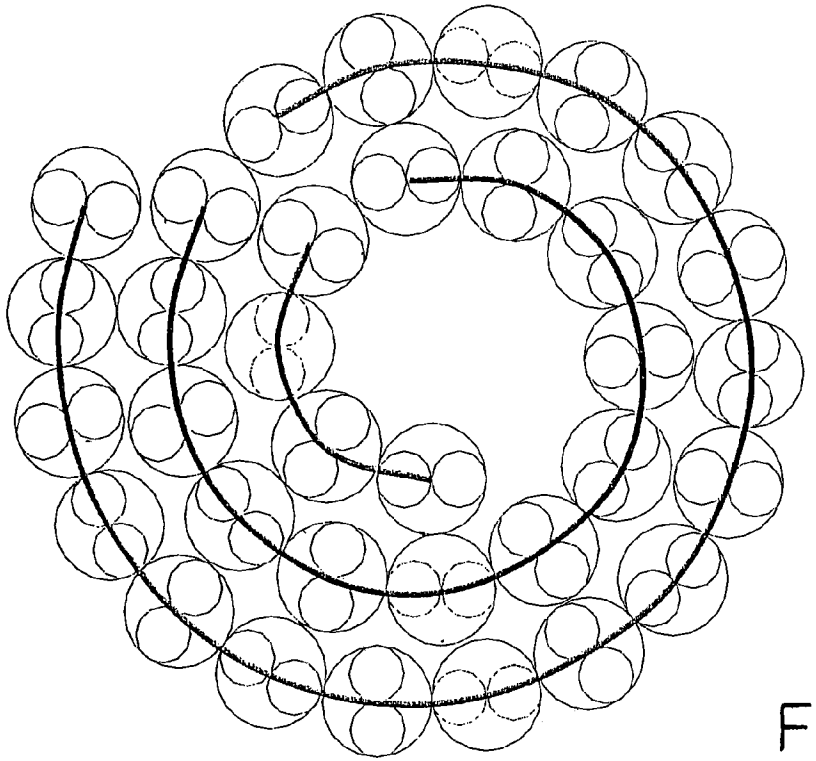
Figure 5D:
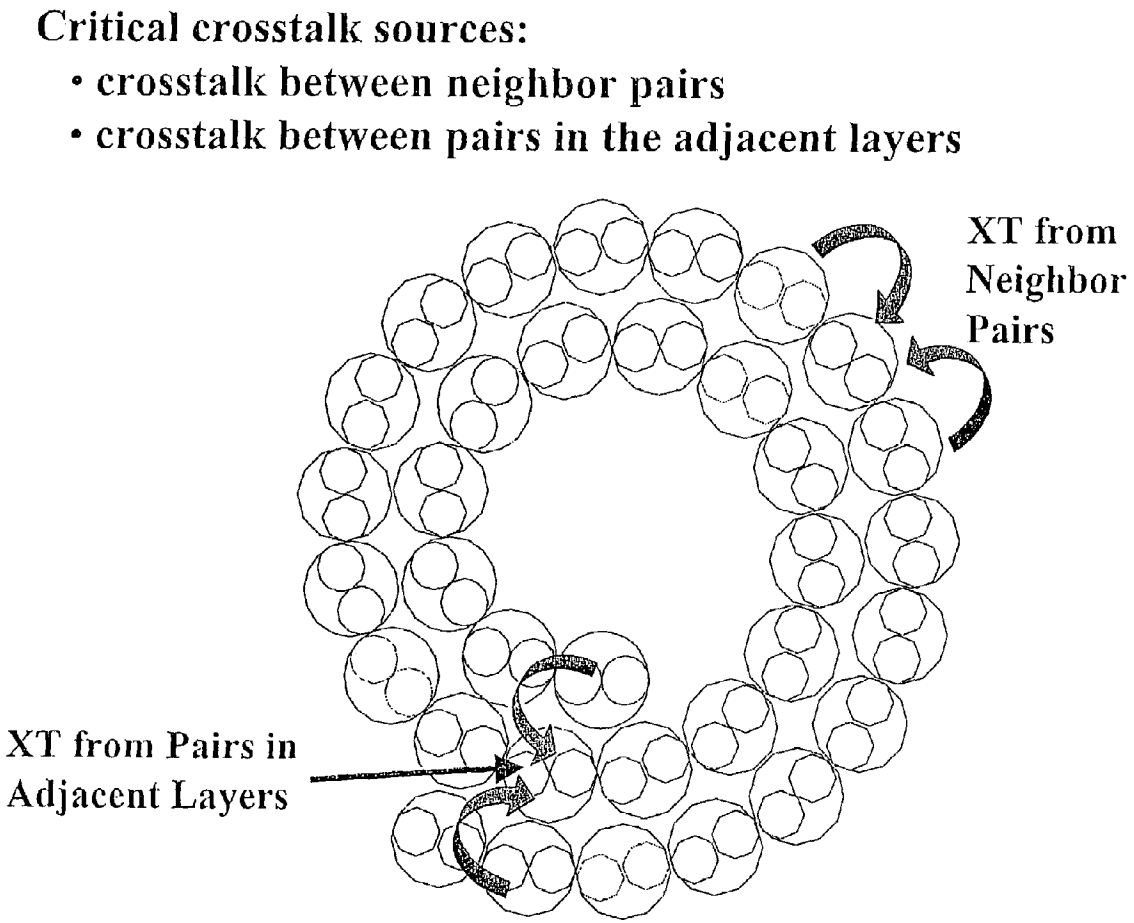
FIG. 5(D) shows the crosstalk between the neighboring twisted pairs located in the same layer and located respectively in the different neighboring layer.

Alternatively, referring to FIG. 5C, adopting different pitch arrangements between the neighboring pairs located in different odd/even layers, and the ratio of such a different pitch arrangement may be 1:2 or in reverse to achieve the best crosstalk cancellation.

Figure 6A:
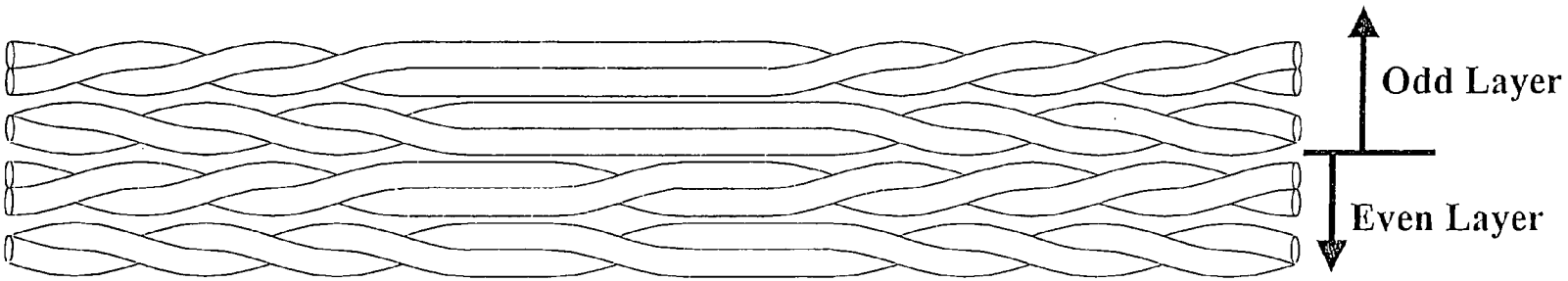
Figure 7:
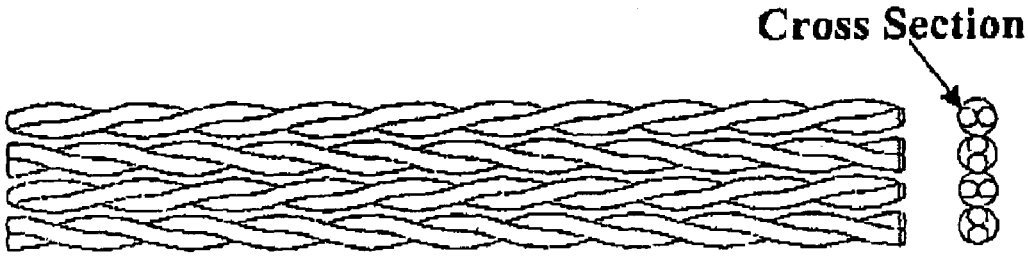
FIG 7 (PRIOR ART)
FIG. 7 shows the flat twisted pair cable.
Figure 8:
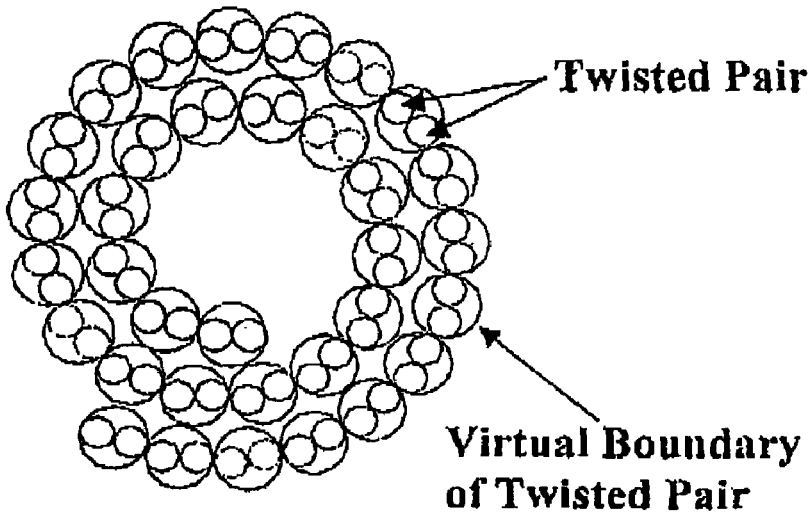
FIG 8 (PRIOR ART)
FIG. 8 shows the round-flat twisted pair cable.

Understandably, during the manufacturing of the round-flat cable for termination in the multi-drop applications and torsion relief in the long cable. The latter will raise crosstalk concern after the rolling process and the solutions are as follows:

A 180 degrees phase change is introduced at the middle of the flat cable for every other layer to cancel out the crosstalk as show in FIG. 6A wherein in the middle portion of the cable assembly the twisted pairs in the odd layer are kept flat while those in the even layer twisting with 180 degrees.

Alternatively, generally the length of the flat section is an integral multiple of the twisting pitch. The flat sections at every other layer are shifted with some distance relative to those of the neighboring layer so that there is an offset between the flat sections in the odd layer and those in the even layer as shown in FIG. 6B.

It is noted that the description of the so-called even layer and odd layer above is only for easy illustration purpose because the whole cable assembly is essentially a continuous single layer by a rolling process, and such an illustration is to differentiate the neighboring layers in a cross-sectional view along a specific radial direction for easy explanation only.

In brief, similar to the inventor's previous designs, the advantage of the instant invention is to cancel out the crosstalk noise in the short distance, and this arrangement will give the uniform differential impedance and propagation delay with easy manufacturing. The basic theory as disclosed in the previous designs, is to use 90 degrees phase offset to reduce the crosstalk between the neighboring twisted pairs. Specifically, the instant invention is to apply the similar theory upon the round-flat twisted pair 3D cable rather than the planar 2D cable. Because of the rolling procedure, the design parameter is the rolling angle of the subject twisted pair with respect to the previous neighboring twisted pair, which depends upon the final diameter of the round cable, the twisted pair sequence number, and even the tightness of the rolling process. Anyhow, as mentioned earlier, the general solution for any kind of phase offset is derived from the uniform twist pitch.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims. Therefore, person of the ordinary skill in this field at to understand that all such equivalent structures are to be include in the scope of the following claims.

I claim:

1. A round-flat twisted pair cable assembly comprising:

a plurality of twisted pairs rolled together;

each of said twisted pairs defining a local phase offset angle with regard to a neighboring twisted pair, and a global pair centerline angle with regard to a global horizontal axis, said twisted pairs being characterized in that:

$\theta_{Gi}=\frac{1}{2}\xi[1+(-1)^i]+(-1)^{i-1}\eta-[\Sigma\alpha_j+(-1)^i\Sigma(-1)^j\alpha_j]$ under a condition of j=2 to i; wherein i and j are integrals, $\theta_{Gi}$ represents the global pair centerline angle of pair i, $\xi$ represents the local phase offset angle between pair i and pair i−1, $\eta$ represents the global pair centerline angle of pair 1, and $\alpha_j$ represents the angle between the centerline defined by centers of pairs j and j−1, and another centerline defined by centers of pairs j−1 and j−2.

2. The cable assembly as claimed in claim 1, wherein a metal shield film is located between neighboring layers taken in a cross-sectional view.

3. The cable assembly as claimed in claim 1, wherein a pitch of the twisted pairs in one layer and that in a neighboring layer, taken in a cross-sectional view, have an integral ratio therebetween.

4. The cable assembly as claimed in claim 1, wherein the twisted pairs have flat sections, and there is a 180 degrees difference between the two neighboring flat sections of the two corresponding neighboring pairs respectively located in different neighboring layers, taken in a cross-sectional view.

5. The cable assembly as claimed in claim 1, wherein the twisted pairs have flat sections, and there is an offset, in an axial direction between the two neighboring flat sections of the two corresponding neighboring pairs respectively located in different neighboring layers, taken in a cross-sectional view.

6. The cable assembly as claimed in claim 1, wherein $\xi$ is 90 degrees.

7. The cable assembly as claimed in claim 1, wherein pair i and pair i−1 twist in opposite directions with regard to each other.

8. A round-flat twisted pair cable assembly comprising:

a plurality of twisted pairs rolled together;

each of said twisted pairs defining a local phase offset angle with regard to a neighboring twisted pair, and a global pair centerline angle with regard to a global horizontal axis, said twisted pairs being characterized in that:

$\theta_{Gi}=\theta_{Gi-2}-2\alpha_i$; wherein $\theta_{Gi}$ represents the global pair centerline angle of pair i, $\theta_{Gi-2}$ represents the global pair centerline angle of pair i−2, and $\alpha_i$ represents the angle between the centerline defined by centers of pairs i and i−1, and another centerline defined by centers of pairs i−1 and i−2.

9. The cable assembly as claimed in claim 8, wherein a metal shield film is located between neighboring layers taken in a cross-sectional view.

10. The cable assembly as claimed in claim 8, wherein a pitch of the twisted pairs in one layer and that in a neighboring layer, taken in a cross-sectional view, have an integral ratio therebetween.

11. The cable assembly as claimed in claim 8, wherein the twisted pairs have flat sections, and there is a 180 degrees difference between the two neighboring flat sections of the two corresponding neighboring pairs respectively located in different neighboring layers, taken in a cross-sectional view.

12. The cable assembly as claimed in claim 8, wherein the twisted pairs have flat sections, and there is an offset, in an axial direction between the two neighboring flat sections of the two corresponding neighboring pairs respectively located in different neighboring layers, taken in a cross-sectional view.

13. The cable assembly as claimed in claim 8, wherein $\xi$ is 90 degrees.

14. The cable assembly as claimed in claim 8, wherein pair i and pair i−1 twist in opposite directions with regard to each other.

15. A method of making a round-flat twisted pair cable assembly, comprising steps of:

providing a plurality of twisted pairs in a juxtaposed manner;

rolling said twisted pairs in an axial direction parallel to a extension direction of said twisted pairs; wherein each of said twisted pairs defining a local phase offset angle with regard to a neighboring twisted pair, and a global pair centerline angle with regard to a global horizontal axis, said twisted pairs being arranged in one of two following ways:

(1) $\theta_{Gi}=\frac{1}{2}\xi[1+(-1)^i]+(-1)^{i-1}\eta-[\Sigma\alpha_j+(-1)^i\Sigma(-1)^j\alpha_j]$ under a condition of j=2 to i; wherein i and j are integrals, $\theta_{Gi}$ represents the global pair centerline angle of pair i, $\xi$ represents the local phase offset angle between pair i and pair i−1, $\eta$ represents the global pair centerline angle of pair 1, and $\alpha_j$ represents the angle between the centerline defined by centers of pairs j and j−1, and another centerline defined by centers of pairs j−1 and j−2; and (2) $\theta_{Gi}=\theta_{Gi-2}-2\alpha_i$; wherein $\theta_{Gi}$ represents the global pair centerline angle of pair i, $\theta_{Gi-2}$ represents the global pair centerline angle of pair i−2, and $\alpha_i$ represents the angle between the centerline defined by centers of pairs i and i−1, and another centerline defined by centers of pairs i−1 and i−2.

16. The method as claimed in claim 15, wherein a metal shield film is located between neighboring layers taken in a cross-sectional view.

17. The method as claimed in claim 15, wherein a pitch of the twisted pairs in one layer and that in a neighboring layer, taken in a cross-sectional view, have an integral ratio therebetween.

18. The method as claimed in claim 15, wherein the twisted pairs have flat sections, and there is a 180 degrees difference between the two neighboring flat sections of the two corresponding neighboring pairs respectively located in different neighboring layers, taken in a cross-sectional view.

19. The method as claimed in claim 15, wherein the twisted pairs have flat sections, and there is an offset, in an axial direction between the two neighboring flat sections of the two corresponding neighboring pairs respectively located in different neighboring layers, taken in a cross-sectional view.

20. The method as claimed in claim 15, wherein $\xi$ is 90 degrees, or pair i and pair i−1 twist in opposite directions with regard to each other.

* * * * *